US009346305B2

(12) United States Patent
Albertin et al.

(10) Patent No.: US 9,346,305 B2
(45) Date of Patent: May 24, 2016

(54) DEVICE FOR INK-JET PRINTING A SURFACE

(75) Inventors: Alberto Albertin, Arnad (IT); Guido Belforte, Turin (IT); Tazio Sandri, Arnad (IT); Duccio Spartaco Sassano, Arnad (IT); Vladimir Viktorov, Turin (IT); Carmen Visconte, Turin (IT); Francesco Benedetto, Arnad (IT); Charles-Henri Delacretaz, Yverdon-les-Bains (CH); Rinaldo Ferrarotti, Arnad (IT); Matteo Martinelli, Turin (IT); Terenziano Raparelli, Turin (IT)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 14/124,393

(22) PCT Filed: Jun. 8, 2012

(86) PCT No.: PCT/IB2012/052903

§ 371 (c)(1),
(2), (4) Date: May 20, 2014

(87) PCT Pub. No.: WO2012/168913

PCT Pub. Date: Dec. 13, 2012

(65) Prior Publication Data

US 2014/0246510 A1 Sep. 4, 2014

(30) Foreign Application Priority Data

Jun. 8, 2011 (IT) ..... MI2011A1034

(51) Int. Cl.
*B41M 5/00* (2006.01)
*B41J 2/175* (2006.01)
*B41J 2/18* (2006.01)

(52) U.S. Cl.
CPC ..... *B41M 5/0047* (2013.01); *B41J 2/175* (2013.01); *B41J 2/18* (2013.01)

(58) Field of Classification Search
CPC .... B41J 2/175; B41J 2/17553; B41J 2/17556; B41J 2/17596; B41J 2/18; B41J 2/305
See application file for complete search history.

(56) References Cited

U.S. PATENT DOCUMENTS

| | | | | |
|---|---|---|---|---|
| 6,371,607 | B2 * | 4/2002 | Wouters et al. | 347/89 |
| 7,597,434 | B2 * | 10/2009 | Nitta et al. | 347/89 |
| 7,815,277 | B2 * | 10/2010 | Yamada | 347/17 |
| 7,845,784 | B2 * | 12/2010 | Nitta et al. | 347/89 |
| 7,901,063 | B2 * | 3/2011 | Wouters et al. | 347/89 |

(Continued)

FOREIGN PATENT DOCUMENTS

| | | |
|---|---|---|
| EP | 1361066 | 11/2003 |
| EP | 2093065 | 8/2009 |

(Continued)

OTHER PUBLICATIONS

Japanese Office Action conducted in counterpart Japan Appln. No. 2014-514212 (Jul. 21, 2015) (w/ English translation).

(Continued)

*Primary Examiner* — Manish S Shah
*Assistant Examiner* — Renee I Wilson
(74) *Attorney, Agent, or Firm* — Greenblum & Bernstein, P.L.C.

(57) ABSTRACT

An ink-jet printing device is described, said device comprising a first reservoir designed to contain a first volume of printing fluid at a first height with respect to a reference plane, a supply system for forcing the printing fluid towards the first reservoir and a second reservoir designed to contain a second volume of printing fluid at a second height with respect to the reference plane. The second height is less than the first height by a value. The device also comprises a conduit designed to receive the printing fluid from the first reservoir and convey it towards the second reservoir and an ejection plane in which ejector units lie. The ejection plane is arranged in a position higher than the average of the first height and the second height, so as to generate a back pressure in the ejector units. The flowrate of the printing fluid is between about 5 and about 10 times the maximum flowrate which can be ejected from said ejector units. The printing fluid may be a ceramic ink.

6 Claims, 14 Drawing Sheets

(56) References Cited

U.S. PATENT DOCUMENTS

| | | | | |
|---|---|---|---|---|
| 8,157,365 | B2 * | 4/2012 | Wouters et al. | 347/92 |
| 2005/0046682 | A1 | 3/2005 | Kawamoto | |
| 2009/0160887 | A1 | 6/2009 | Hamazaki et al. | |
| 2009/0295881 | A1 | 12/2009 | Tasaka et al. | |
| 2010/0039486 | A1 * | 2/2010 | Wouters et al. | 347/92 |
| 2010/0110155 | A1 | 5/2010 | DeLueg | |
| 2010/0177148 | A1 * | 7/2010 | Asami | 347/85 |
| 2011/0139901 | A1 * | 6/2011 | Menzel et al. | 239/398 |

FOREIGN PATENT DOCUMENTS

| | | |
|---|---|---|
| EP | 2127883 | 12/2009 |
| JP | 2002-029064 | 1/2002 |
| JP | 2002-086735 | 3/2002 |
| JP | 2002-533247 | 10/2002 |
| JP | 2004-249741 | 9/2004 |
| JP | 2006-192638 | 7/2006 |
| JP | 2010-158878 | 7/2010 |
| JP | 2011-073434 | 4/2011 |
| WO | 00/38928 | 7/2000 |
| WO | 2009/143362 | 11/2009 |

OTHER PUBLICATIONS

Chinese Office Action conducted in counterpart China Appln. No. 201280028108.0 (Feb. 12, 2015) (w/ English translation).

* cited by examiner

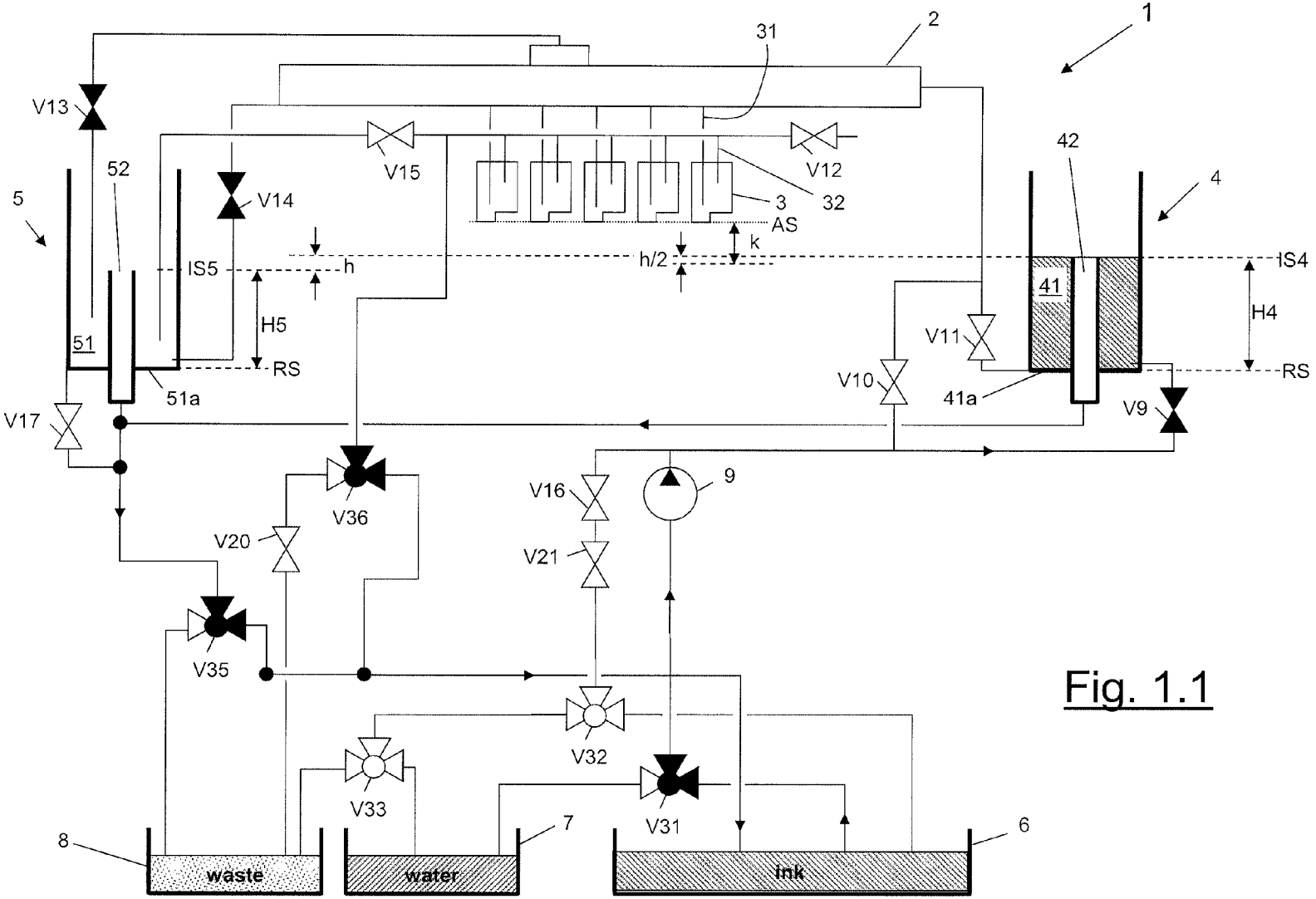
Fig. 1.1

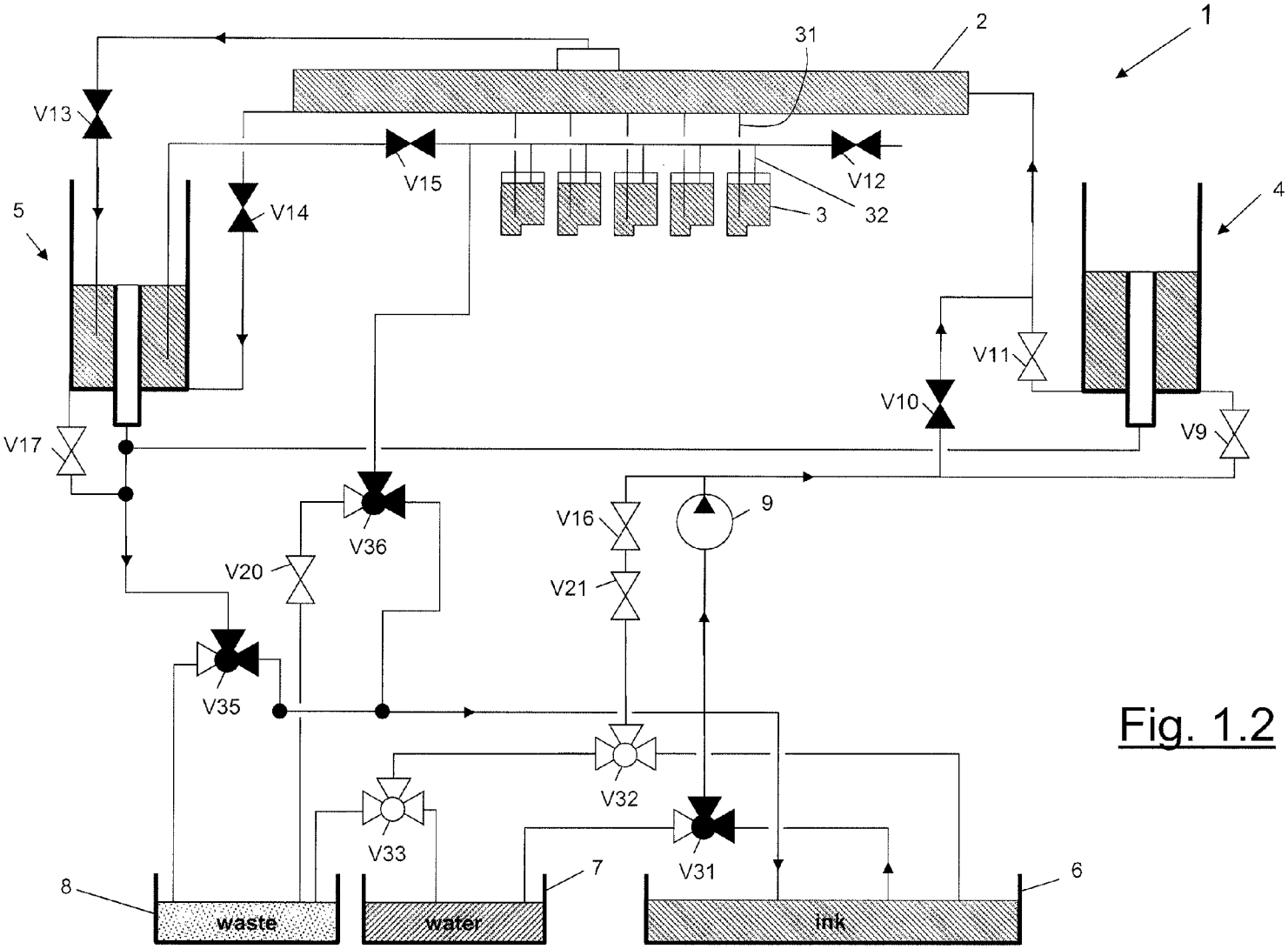
Fig. 1.2

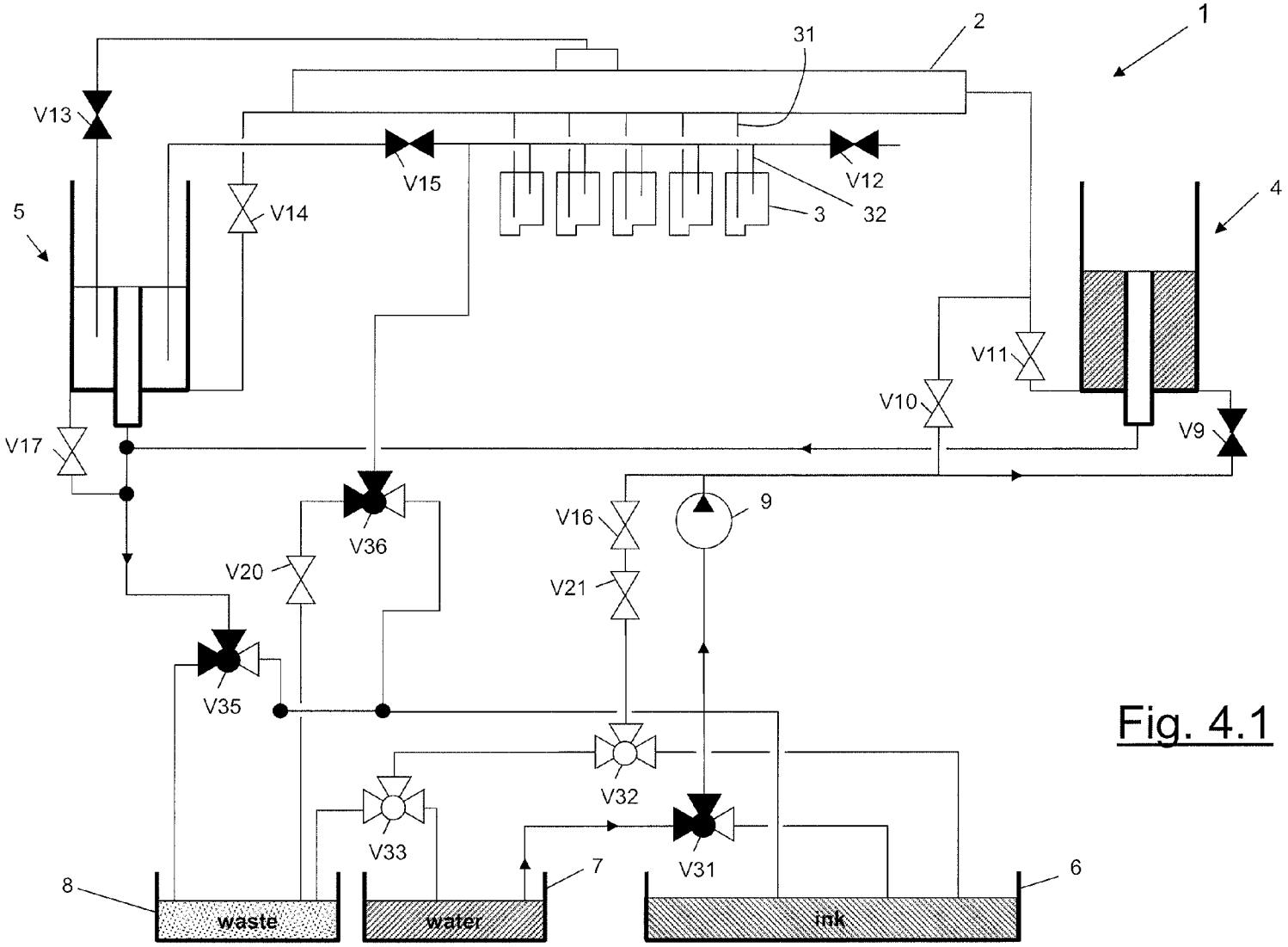
Fig. 4.1

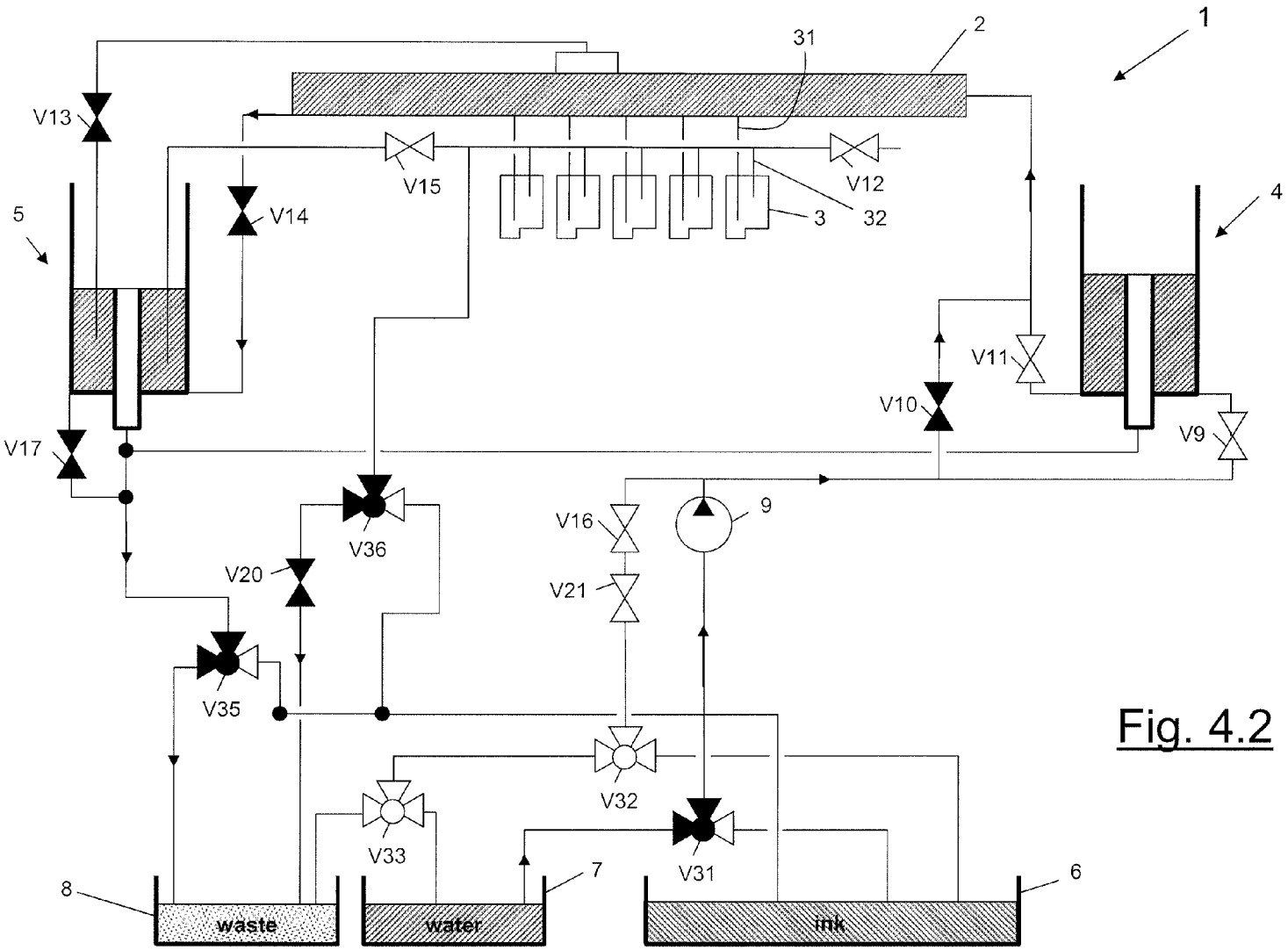
Fig. 4.2

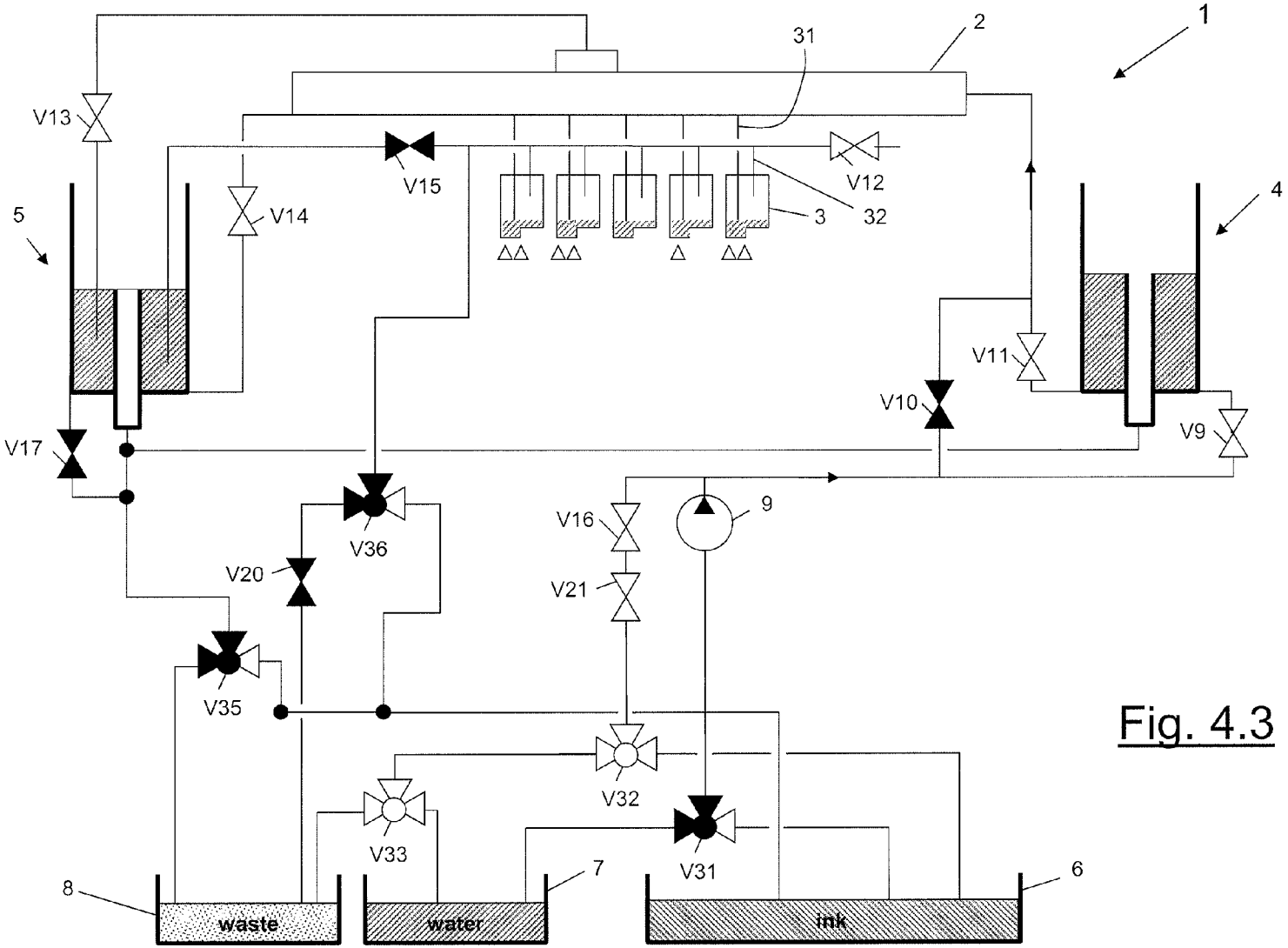
Fig. 4.3

DEVICE FOR INK-JET PRINTING A SURFACE

CROSS-REFERENCE TO RELATED APPLICATIONS

The present application is a U.S. National Stage of International Patent Application No. PCT/IB2012/052903 filed Jun. 8, 2012, and claims priority under 35 U.S.C. §§119 and 365 of Italian Patent Application No. MI2011A001034 filed Jun. 8, 2011.

BACKGROUND OF THE INVENTION

1. Field of the Invention

The present invention relates to a printing device, for example for printing a glass surface or a ceramic surface using ink-jet heads, in particular thermal and/or piezoelectric ink-jet heads.

2. Discussion of Background Information

Devices for printing surfaces, for example ceramic surfaces, using ceramic inks are known. Ceramic inks are dispersed systems comprising solid pigments suspended in a liquid. The pigments used in this field are generally oxides or inorganic salts which are characterized not only by chromatic properties, but also by a very high thermal stability able to withstand firing at the high temperatures (800-1200° C.) which are typical of the ceramic process. Typically, the known ceramic inks have a high density, of up to about 4-5 g/cm$^3$, much higher than the density (usually 1-2 g/cm$^3$) of an organic pigment used in conventional ink-jet printers.

EP 2,093,065 describes a system for supplying ink for printers.

SUMMARY OF THE EMBODIMENTS

The Applicant has noted that the use of ceramic inks involves problems of sedimentation of the said inks inside the printing system, this phenomenon making the printing system unusable.

The Applicant has considered the problem of sedimentation. According to the Applicant, the problem of sedimentation may be solved by circulating the ink in a circuit with a high and stable fluid flowrate.

According to a first aspect of the invention, an ink-jet printing device is provided, said device comprising a first reservoir containing a first volume of printing fluid at a first height with respect to a reference plane, a supply system for forcing the printing fluid towards said first reservoir, a second reservoir containing a second volume of printing fluid at a second height with respect to said reference plane, wherein said second height is less than said first height by a value, a conduit which receives the printing fluid from said first reservoir and conveys the printing fluid towards the second reservoir, an ejection plane in which ejector units lie, wherein said ejection plane is arranged in a position which is higher than the average of said first height and said second height, so as to generate a back pressure in the ejector units, wherein a flowrate of said printing fluid inside the conduit is greater than a maximum flowrate which can be ejected from said ejector units, wherein the flowrate of the printing fluid is between about 5 and about 10 times the maximum flowrate which can be ejected from said ejector units. The printing fluid may be a ceramic ink with a high density, for example of up to about 4 g/cm$^3$ or 5 g/cm$^3$.

Preferably, the difference in height between the first height and the second height is between about 10 mm and about 1000 mm.

Preferably, the ejection plane is arranged in a position higher than the average of the first height and the second height by a value of between about 30 mm and about 100 mm so as to generate the corresponding back pressure in the ejector units.

Preferably, the first and second reservoirs are spillway or overflow reservoirs.

Preferably, the first reservoir comprises a bottom and a free surface at a height from the bottom, the second reservoir comprises a bottom and a free surface at a height from the bottom, the height between the bottom and the free surface of the first reservoir is greater than the height between the bottom and the free surface of the second reservoir and the bottom of the first reservoir and the bottom of the second reservoir lie in the same horizontal plane.

Preferably, the first reservoir comprises a bottom and a free surface at a height from the bottom, and the second reservoir comprises a bottom and a free surface at a height from the bottom, the heights from the bottom are the same and the bottom of the second reservoir is at a lower height than the bottom of the first reservoir.

Preferably, the first reservoir comprises a discharge outlet and the second reservoir comprises a discharge outlet, the discharge outlets being in fluid communication with each other.

According to preferred embodiments, the device also comprises a vessel for containing a volume of printing fluid, for example ink, and for collecting printing fluid discharged at least from the conduit.

Preferably, the device also comprises a vessel for containing a volume of washing fluid for flushing at least the reservoir and the conduit.

Preferably, the device also comprises a plurality of thermal ink-jet heads, each of said heads comprises a printing fluid container, an ejector unit with a nozzle plate, a fluid supplying/emptying pipe connected to the conduit and an outlet pipe, and the container does not contain sponge-like bodies or the like.

Preferably, the device also comprises a plurality of modules, each module comprises two or more ejector units, a printed circuit and a header for defining a single volume for containing printing fluid for the ejector units, and the header is designed to be connected in fluid communication with the conduit and to receive printing fluid from the conduit.

Preferably, each header of each module comprises a plurality of chimneys designed to sealing engage inside corresponding openings of the conduit.

Preferably, the conduit comprises two parallel tubes connected by a U-shaped joint.

The device preferably also comprises a series of connection tubes which form a hydraulic circuit for continuous circulation of the printing fluid inside the conduit at an adjustable speed.

According to a second aspect of the invention, a module for an ink-jet printing device is provided, said module comprising two or more ejector units, a printed circuit, a head support and a header for defining a single volume for containing printing fluid for the ejector units, wherein the header is designed to be connected in fluid communication with a conduit and to receive printing fluid from the conduit. The module may form part of the device mentioned above.

Preferably, the module comprises two rows of ejector units, wherein the ejector units of one row are staggered with respect to the ejector units of the other row.

Preferably, the header comprises a plurality of chimneys designed to sealing engage inside corresponding openings of the conduit.

According to preferred embodiments, the head support comprises graphite.

According to a third aspect of the invention a method for supplying an ink-jet printing device with a printing fluid is provided, said method comprising:

supplying, with printing fluid, a first reservoir designed to contain a first volume of printing fluid at a first height with respect to a reference plane;

supplying the printing fluid from the first reservoir via a conduit to an ejection plane in which ejector units lie;

supplying the printing fluid from the conduit to a second reservoir designed to contain a second volume of printing fluid at a second height with respect to the reference plane;

wherein the second height is less than the first height by a value so as to obtain a flow of printing fluid between said first reservoir and said second reservoir, wherein the flowrate of printing fluid inside the conduit is greater than the maximum flowrate which can be ejected from said ejector units, the flowrate of the printing fluid is between about 5 and about 10 times the maximum flowrate which can be ejected from the ejector units.

Preferably, the printing fluid is circulated continuously inside the conduit at an adjustable speed. The printing fluid may be a ceramic ink with a high density, for example of up to about 4 g/cm$^3$ or 5 g/cm$^3$.

According to another aspect of the invention, a method for supplying an ink jet printing device with a printing fluid is disclosed, wherein an ejection plane is arranged in a position higher than the average of a first height and a second height, so as to generate a back pressure at the ejector units.

Embodiments of the instant invention are directed to an ink-jet printing device that includes a first reservoir structured and arranged to contain a first volume of printing fluid at a first level with respect to a reference plane, a supply system structured to force the printing fluid towards the first reservoir, and a second reservoir structured and arranged to contain a second volume of printing fluid at a second level with respect to the reference plane, such that the second level is lower, relative to the reference plane, than the first level by a level difference value. A conduit is structured and arranged to receive the printing fluid from the first reservoir and to convey the printing fluid towards the second reservoir and an ejection plane in which ejector units lie is formed. The ejection plane is located at a height relative to the reference plane that is higher than an average of the first level and the second level so as to generate a back pressure in the ejector units. A flowrate of the printing fluid inside the conduit is greater than a maximum flowrate of the printing fluid ejectable from the ejector units.

In embodiments, the flowrate of the printing fluid may be between about 5 and about 10 times the maximum flowrate of the printing fluid ejectable from the ejector units.

According to embodiments, the level difference value can be between about 10 mm and about 1000 mm.

In accordance with other embodiments, the height at which the ejection plane is located can be between about 30 mm and about 100 mm higher than the average of the first and second level so as to generate the corresponding back pressure in the ejector units.

In embodiments, the first and second reservoirs can include spillway or overflow reservoirs. Further, the first reservoir may include a first bottom and a first free surface at a first height from the first bottom, the second reservoir may include a second bottom and a second free surface at a second height from the second bottom and the first height can be greater than the second height. Moreover, the bottom of the first reservoir and the bottom of the second reservoir can lie in a horizontal plane.

In other embodiments, the first reservoir may include a first bottom and a first free surface at a first height from the first bottom, the second reservoir may include a second bottom and a second free surface at a second height from the second bottom, and the first and second heights can be the same. Further, the second bottom may be located lower than the first bottom relative to the reference plane.

According to still other embodiments of the invention, the first reservoir can include a first discharge outlet, the second reservoir may include a second discharge outlet and the first and second discharge outlets can be in fluid communication with each other.

In accordance with further embodiments, the vessel can be structured and arranged to contain a volume of printing fluid and to collect printing fluid discharged from at least the conduit. Further, the printing fluid may be ink.

In further embodiments, a vessel can be structured and arranged to contain a volume of washing fluid for flushing at least the first reservoir and the conduit.

In still other embodiments of the invention, a plurality of thermal ink jet heads may be structured so that each of the heads includes a printing fluid container, an ejector unit with a nozzle plate, a fluid supplying/emptying pipe connected to the conduit and an outlet pipe. However, the container does not contain sponge-like bodies or the like.

According to further embodiments, a plurality of modules may be structured and arranged so that each module comprises at least two ejector units, a printed circuit and a header for defining a single volume for containing printing fluid for the ejector units. The header can be structured to be in fluid communication with the conduit and to receive printing fluid from the conduit. Moreover, each header of each module may include a plurality of chimneys designed to sealing engage inside corresponding openings of the conduit.

According to still other embodiments, the conduit can include two parallel tubes connected by a U-shaped joint.

In accordance with still further embodiments, a series of connection tubes can be structured and arranged to form a hydraulic circuit for continuous circulation of the printing fluid inside the conduit at an adjustable speed.

In further embodiments, a module can include at least two ejector units, a printed circuit, a head support and a header for defining a single volume structured to contain printing fluid for the ejector units. The header can be structured and arranged to be connected in fluid communication with the conduit and to receive printing fluid from the conduit. Moreover, the at least two ejector units may include two rows of ejector units that arranged so that a plurality of ejector units in one row are staggered with respect to a plurality of ejector units of the other row. The header can include a plurality of chimneys structured and arranged to sealing engage inside corresponding openings of the conduit. Still further, the head support may be graphite.

In other embodiments, the printing fluid can be a ceramic ink.

Embodiments are directed to a method for supplying an ink-jet printing device with a printing fluid. The method includes supplying to a first reservoir a first volume of printing fluid to a first level with respect to a reference plane, supplying, via a conduit, the printing fluid from the first reservoir to an ejection plane in which ejector units are arranged and supplying to a second reservoir from the conduit a second volume of printing fluid to a second level with respect to the reference plane. The method also includes arranging the second level lower in relation to the reference plane than the first level by a level difference value to obtain a flow of printing fluid between the first reservoir and the second reservoir, so that a flowrate of the printing fluid inside the conduit is greater than a maximum flowrate of the printing fluid ejectable from the ejector units.

In accordance with embodiments of the method, the flowrate of the printing fluid in the conduit can be between about 5 and about 10 times the maximum flowrate of the printing fluid ejectable from the ejector units.

According to further embodiments, the method can include continuously circulating the printing fluid inside the conduit at an adjustable speed.

In accordance with still yet other embodiments of the method, the printing fluid can be a ceramic ink.

BRIEF DESCRIPTION OF THE DRAWINGS

The invention will become entirely clear from the detailed description which follows, provided by way of a non-limiting example to be read with reference to the accompanying drawings in which:

FIGS. 1.1 and 1.2 show schematically the ink filling steps in a first embodiment of the device according to the invention;

FIGS. 4.1, 4.2 and 4.3 show the same device in a washing configuration;

DETAILED DESCRIPTION OF THE EMBODIMENTS

Figure 2:
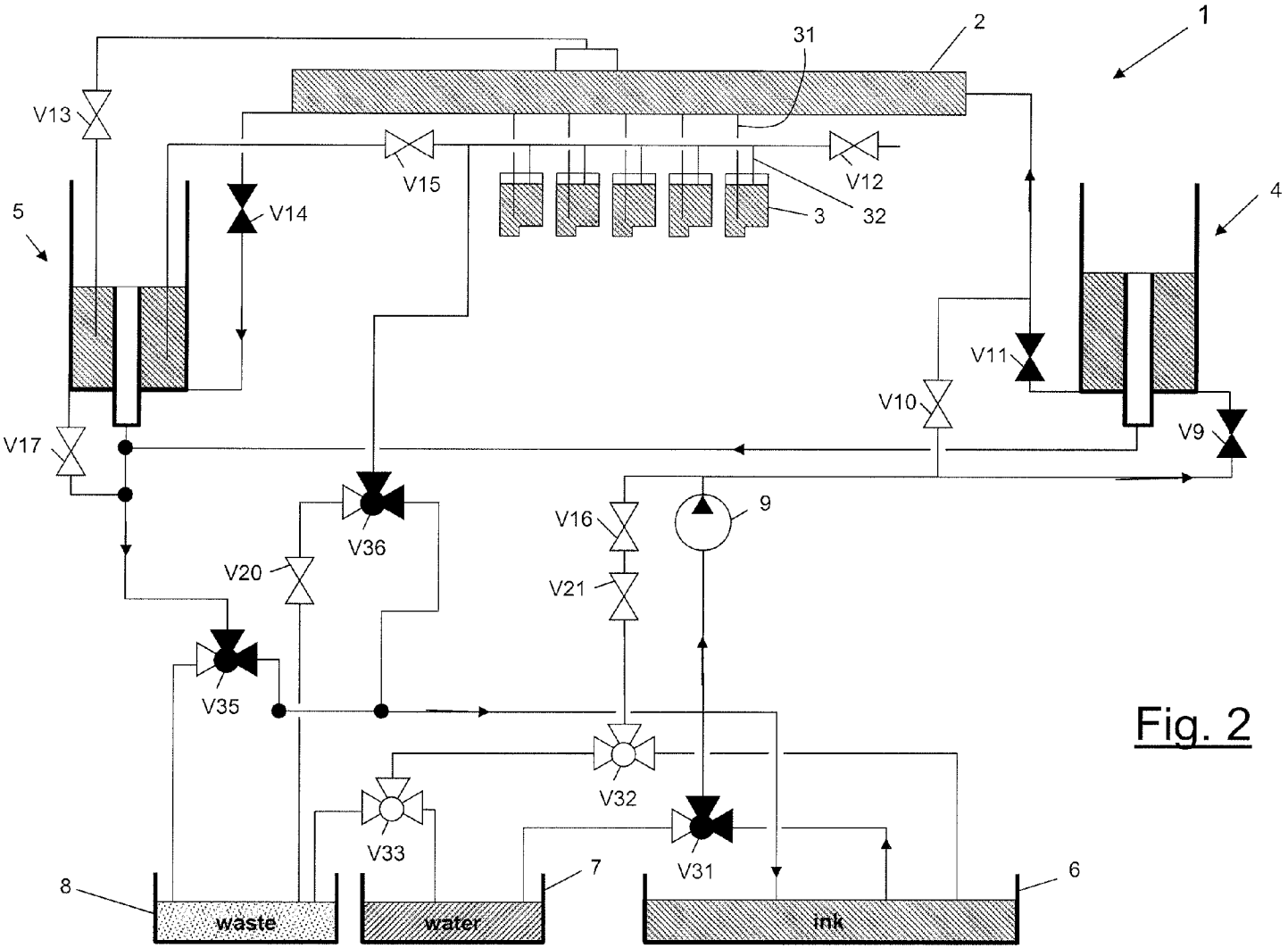
FIG. 2 shows the same device in a steady state working configuration.

The device in its entirety is denoted by the reference number 1.

Preferably, the device according to the present invention allows at least one of the following functions to be performed:

- supplying one or more conduits to which print heads are connected;
- creating inside the conduit a back pressure which can be adjusted by the relative positions of two free surfaces and the level of the nozzle plates, suitable for ensuring correct operation of the heads;
- keeping the ink in constant circulation inside the conduit at an adjustable speed so that the flowrate in the conduit is greater than the maximum flowrate which can be ejected from all the heads simultaneously;
- filling the conduit and the connected heads with ink and emptying them;
- washing, using a special fluid, the entire system, including the conduit, the connected heads, and the entire connected hydraulic circuit.

As shown in FIGS. 1.1 to 5, the device 1 comprises a conduit 2, a plurality of print heads 3, a first reservoir 4 for maintaining a first level of printing fluid (typically ink), a second reservoir 5 for maintaining a second level of printing fluid, a first vessel 6 which contains the printing fluid, a second vessel 7 which contains washing fluid, a third vessel 8 which collects the waste fluid, a plurality of valves V, a pump 9, a series of connection tubes (not identified singly) which form a hydraulic circuit and which form a fluid connection for the above-mentioned components, as will become clear from the accompanying figures and the following detailed description.

The valves are indicated by oppositely arranged triangles and are identified by the letter V followed by a number. According to the conventionally used symbols, open valves (through which the fluid flows) are denoted by small black triangles, while closed valves (where the fluid is interrupted) are identified by small white triangles. A two-way valve is represented by two small oppositely arranged triangles, while a three-way valve is represented by three triangles converging towards a sphere.

The first reservoir 4 is preferably a reservoir of the overflow or spillway type. It may assume any form, but preferably comprises a fluid containing volume 41 and a discharge volume 42 for conveying downstream the excess fluid which flows over. Advantageously, the first reservoir 4 may have a cylindrical form and the discharge volume 42 could be in the form of a central cylindrical cup (with an open bottom) which receives excess fluid flowing over the top rim of the cup.

H4 denotes the height between a reference surface RS and the free surface IS4 of the fluid inside the reservoir 4. The free surface IS4 of the fluid is determined by the height of the rim of the cup with respect to the bottom of the first reservoir 4. In fact, the fluid inside the first reservoir 4 may reach only the rim of the cup. Beyond this edge, it flows over inside the cup and then flows out from the discharge outlet of the first reservoir. In FIG. 1.1, the reference surface RS is the surface on which the bottom of the first reservoir 4 lies. In other embodiments not shown, the reference surface may be any flat surface which is parallel to the plane of the free surface of the first reservoir, which is closer (hence higher up) or more distant (hence lower down) with respect to the bottom of the first reservoir 4.

The second reservoir 5 has preferably a form similar to that of the first reservoir 4 and therefore a detailed description thereof will not be repeated. Corresponding parts will be indicated by corresponding reference numbers (replacing the number 4 with the number 5).

In the embodiment shown in FIGS. 1-5, the bottom 51*a* of the second reservoir 5 is substantially at the same height as the bottom 41*a*. However, preferably, the height H4 is greater than the height H5 by an amount h.

In another embodiment (not shown), the first reservoir 4 has the same form and the same dimensions as the second reservoir 5. Therefore, the height of the free surface with respect to the bottom is the same in both reservoirs 4 and 5. In this embodiment (not shown), the bottom 51*a* of the second reservoir 5 is at a lower height than the bottom 41*a* of the first reservoir 4. Therefore, in this case also, a height difference or difference in levels equal to h is formed between the two free surfaces IS4 and IS5.

The value of h depends on different parameters, including the characteristics of that part of the hydraulic circuit which lies between the first reservoir 4 and the second reservoir 5, passing through the heads. The value of h may also depend on the chemical/physical characteristics of the printing fluid, in particular, for example, its density and its viscosity. The parameters which influence its geometry and the characteristics of the hydraulic circuit are, for example, the length of the tubes, their section, the length and the section of the conduit, and the printing fluid flow resistance of the materials used for the various components of the hydraulic circuit. The value of h, as will become clear below, helps determine the flowrate of fluid in the circuit in combination with the characteristics of the pump. Preferably, the difference h is between about 10 mm and about 1000 mm with an ink having a density of between about 0.8 and 1.3 g/cm$^3$ and a viscosity of between about 2 and 15 cP (centiPoise).

Preferably, the ink has a density of between about 1.1 and 1.22 g/cm$^3$ and a viscosity of between about 7 and 11 cP (centiPoise).

The density ranging between 0.8 and 1.0 g/cm$^3$ refers to solvent-based inks.

For the same geometry, the more viscous the ink the higher must be the value of h.

Since the pump 9 has a substantially constant flowrate, the value of h determines the flowrate of the fluid inside the device. The flowrate of the pump 9 must be preferably higher than the flowrate determined by the difference h, otherwise the reservoirs 4 and 5, during the printing steps where ink is used, would be emptied and the free surfaces would not be maintained. The flowrate of the ink is very important because a low flowrate or in any case an insufficient flowrate would be responsible for undesirable differences in back pressure in different points along the conduit 2. On the contrary, these differences (or drops) in the back pressure in the tube must be less than about 1 cm of water column. In this way all the heads are uniformly supplied.

Another very important value is the height k between the ejection plane AS, namely the plane in which the actuator units 33 (or more specifically the ejector units or nozzle plates) of the print heads 3 lie (shown in FIG. 6), and the average value of H4 and H5. In fact, in order for the ejectors of the heads to function properly, it is necessary to ensure for example a back pressure equivalent to between about 3 cm and 10 cm of water column for an ink with a density of between 0.8 and 1.3 g/cm$^3$ and a viscosity of between 2 and 15 cP (centiPoise). This back pressure is that which on the one hand avoids the undesirable outflow of ink from the nozzles while on the other hand it must not have too high a value otherwise it would not be possible to refill the ejectors.

With a suitable value of k it is possible to use heads without sponge-like bodies which are generally used to prevent dripping of ink from the heads. The fact that the heads do not have sponge-like bodies means that it is possible to empty substantially entirely the ink from inside the heads, preventing pigment particles from being deposited on the bottom of the heads and adversely affecting operation thereof by blocking up the ink ejection nozzles. Another advantage arising from the absence of sponge-like bodies is that blockage of the sponge-like bodies themselves is prevented, said blockage occurring gradually after a certain number of operating cycles. A further advantage arising from the absence of sponge-like bodies is that it avoids risk of incompatibility between the material of the sponge-like bodies and the ink (which may be based on solvents which are particularly aggressive vis-à-vis certain materials). Owing to the absence of sponge-like bodies it is possible to perform complete and thorough washing of the heads. This in turn means that it is possible to use more easily inks of a different type and/or colour.

Preferably, the conduit 2 is in the form of a cylindrical body. At a first end thereof (right-hand end in FIG. 1.1) a supply line is provided and at its second end (left-hand end in FIG. 1.1) a fluid outlet line is provided. The conduit 2 may be a single conduit, but may also comprise two or more tubes which are connected together. Each tube may have for example a section which is substantially circular or elliptical. By way of example, each tube may have a diameter of about 40-50 mm and a length which is about 800 mm, but may also be as much as 1000 to 2000 mm. The length of the conduit 2 depends on the width of the required printing pass.

A plurality of print heads 3 is connected at the bottom to the conduit 2. In the embodiment shown in FIGS. 1-5, five print heads are in fluid communication with the conduit 2 by respective supplying/emptying pipes 31.

Preferably, the print heads are of the thermal ink-jet type.

Figure 3:
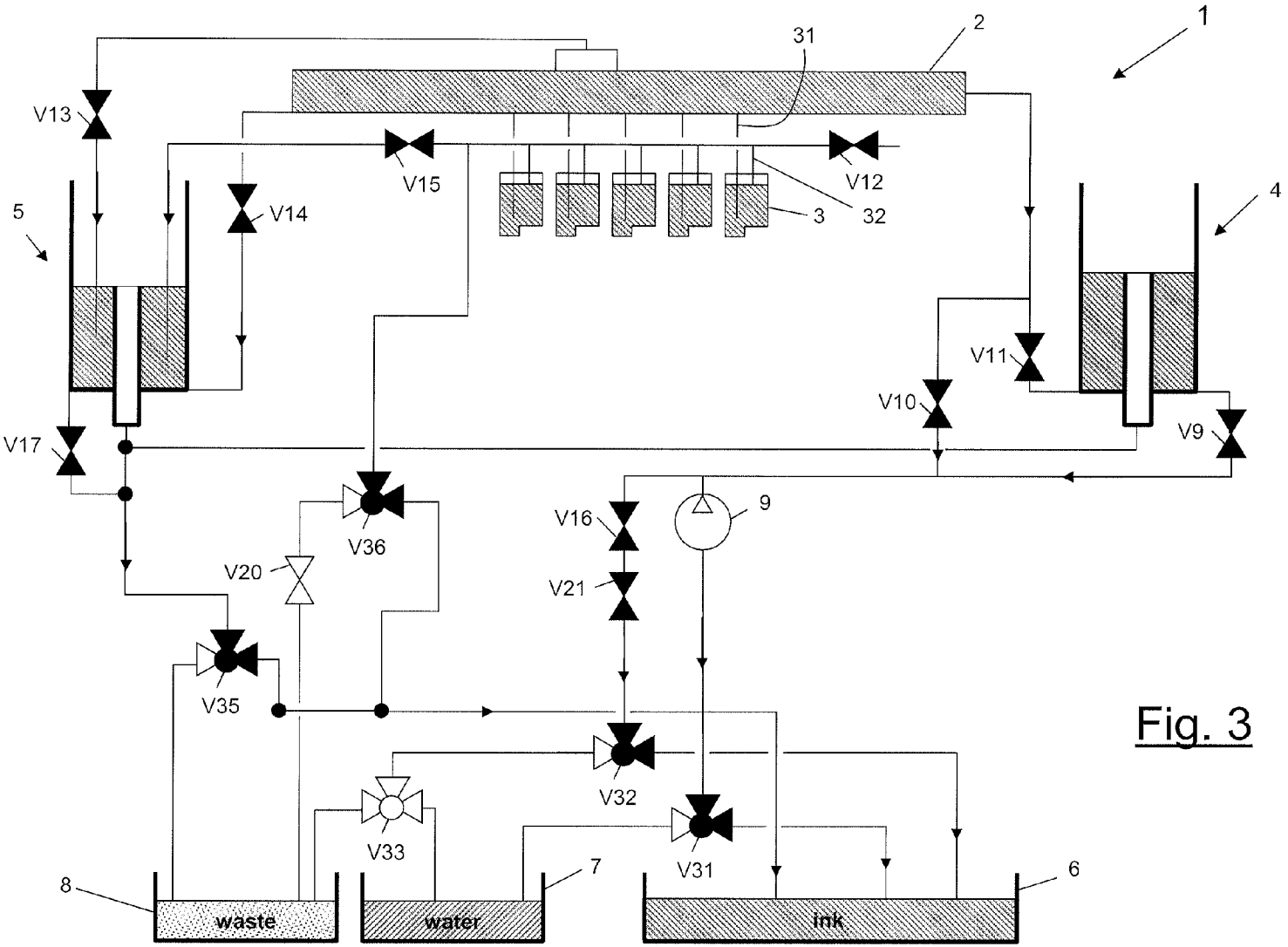
FIG. 3 shows the same device in an ink discharging configuration.

Each supplying/emptying pipe 31 extends preferably inside the head 3 over a certain depth towards the output nozzles (not shown) which are conventionally located in the lowest part of each head, so as to allow emptying of most of the ink from the head during the ink emptying step (FIG. 3). In addition to nozzles, each head also comprises an outlet pipe 32 which is connected to a line section between the valve V12 (which acts as an air vent towards the environment) and the valve V15, so as to allow discharging of the air from the head during the ink filling step (FIG. 1.2).

Figure 5:
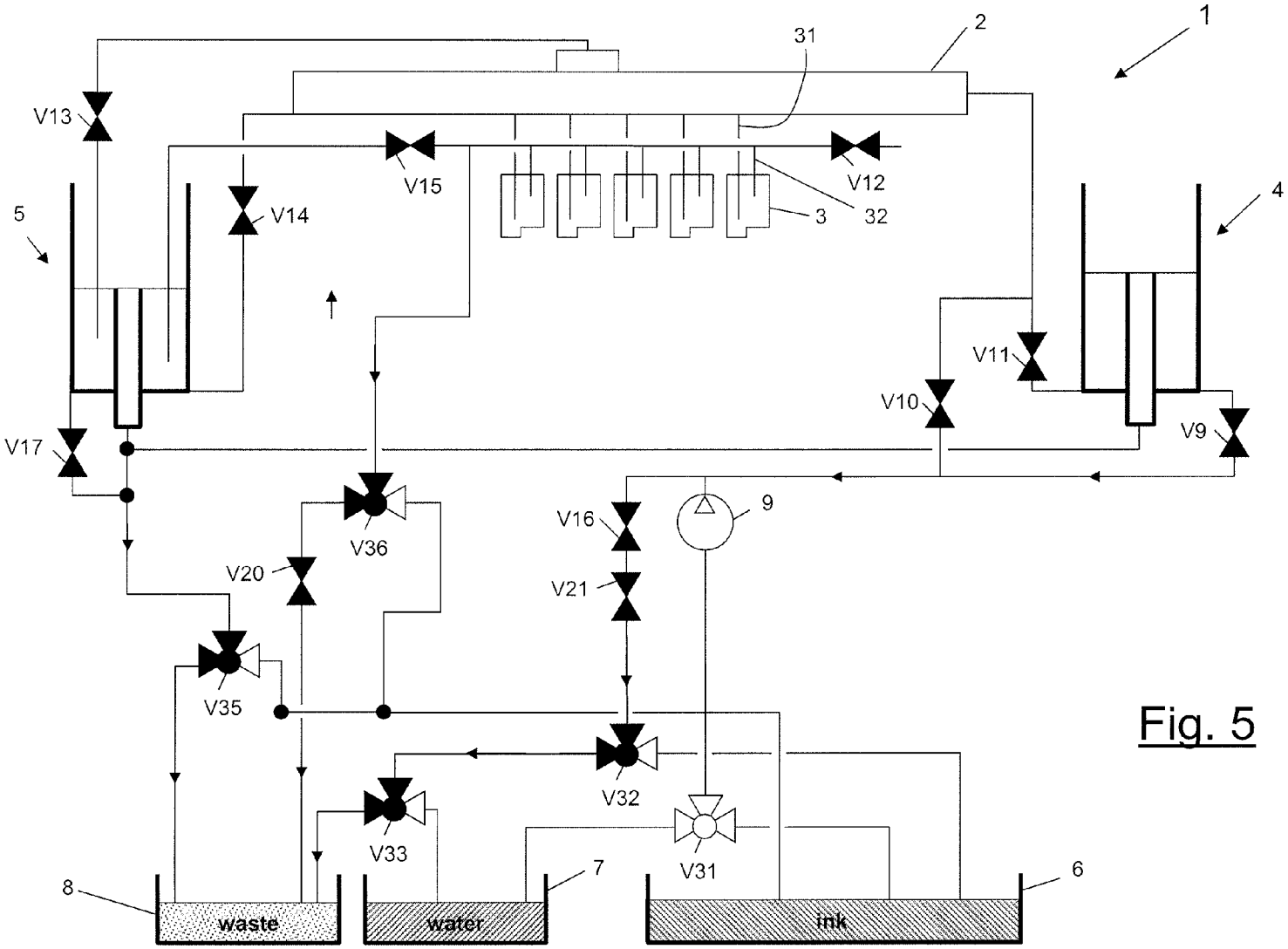
FIG. 5 shows the same device in a washing fluid discharging configuration after the washing step.

Moreover, the output pipe 32 is placed in contact with the atmosphere by opening the valve V12 during the step for emptying the ink (FIG. 3) and the washing fluid (FIG. 5). Each output pipe 32 extends inside the respective head over a depth less than that of the supply pipe, and its end forms the limit of the ink level inside the head. This allows, as will become clearer below, almost complete emptying of the heads, a minimum amount of wasted ink and faster washing.

The ink filling step will now be described with reference initially to FIG. 1.1. During this first part of the filling step, the first overflow reservoir 4 is filled with ink.

The ink is drawn from the ink vessel 6 by the pump 9. The ink flows from the vessel 6 to the three-way valve V31 as far as the first overflow reservoir 4, passing through the valve V9. The volume 41 of the overflow reservoir 4 is filled with ink until the height H4 is reached. The further ink introduced into the first overflow reservoir 4 falls into the discharge outlet and is conveyed towards and introduced back into the vessel 6. Conveniently, in the embodiment shown, it flows until it connects up with the discharge outlet of the second overflow reservoir 5; from here, the excess ink returns to the reservoir 6, passing through the three-way valve 35.

For the sake of clarity, many reference numbers shown in FIG. 1.1 are not shown in the following figures.

The subsequent step (shown in FIG. 1.2) shows filling of the ink inside the conduit 2, the print heads 3 and the second overflow reservoir 5. The first overflow reservoir 4 has already been filled with ink during the filling substep described with reference to FIG. 1.1.

The ink is removed from the ink vessel 6 via the pump 9. From the pump 9 it flows towards the conduit 2 passing through the valve V10 which is in the open position. The valves V11 and V9 are instead closed. The ink fills the conduit 2 and, by means of gravity, the heads 3. The excess ink is also free to flow towards the second overflow reservoir 5 through the open valves V13 and V14. In reality, the valve V14 remains closed until the conduit 2 is completely filled. It is opened only later. The valves V12 and V15 are open so as to allow the air to flow out (from V12) as well as any excess ink (from V15). The excess ink returns to the ink vessel 6 via the valves V35 and V36. The valve V17 remains closed during this step so as to keep the second overflow reservoir 5 full.

Once the ink filling step (FIGS. 1.1 and 1.2) has been completed the full operating step may commence (FIG. 2). The ink is removed from the vessel 6 via the pump 9 and reaches the valve V9 so as to be introduced into the first overflow reservoir 4. Via the valve V11 the ink reaches the conduit 2, owing to the pressure arising from the difference in height h between the free surfaces of the printing fluid in two reservoirs 4 and 5, and the heads 3 by means of gravity. It then flows out of the valve V14 towards the second overflow reservoir 5 so as to fill it up to the overflow edge. The excess ink from the two overflow reservoirs 4 and 5 flows towards the ink reservoir 6 via the valve V35 and is fully recycled. During this step, the valves shown in white are closed and do not allow ink to pass through.

Preferably, the ink is kept in constant circulation inside the conduit 2 at an adjustable speed so that the flowrate inside the conduit 2 is greater than the maximum flowrate which can be ejected from all the heads simultaneously.

The maximum ejectable flowrate is in turn calculated by multiplying the volume of an ejected droplet by the number of nozzles in each head by the number of heads and by the maximum operating frequency. For example, if the nominal volume of each droplet is $150\times10^{-12}$ liters (150 picoliters), if there are five heads, if the number of nozzles per head is 640 and if the maximum operating frequency is 3000 $s^{-1}$, the maximum ejectable flowrate (in picoliters) is $5\times640\times150\times3000=1400\times10^{-6}$ liters/s. The Applicant has established that, for correct operation of the device according to the invention, the actual flowrate of the ink must be preferably between 5 and 10 times this maximum ejectable flowrate calculated as indicated above. Therefore, in the case of the above example, the actual flowrate is preferably between about $7000\times10^{-6}$ liters/s and about $14{,}000\times10^{/-6}$ liters/s.

In the working configuration, compared to the ink filling configuration, the valves V10, V12, V13, V15 and V16 are closed, while the valve V14 is open so as to supply ink from the conduit 2 to the second overflow reservoir 5.

According to the present invention, the printing device 1 is designed so as to allow also complete emptying of the ink from the device itself. FIG. 3 shows the device 1 during emptying of the ink. This operation is very useful because it allows substantially all the ink filled in the system to be recovered and not be dispersed in the environment. Moreover, this operation is advantageous prior to performing the washing step (described below) which allows the device to be washed completely so as to eliminate the possibility of sediments remaining.

During the emptying step, the pump 9 is at a standstill and nearly all the valves are open. Opening of the valves takes place in a suitable sequence, preferably not all simultaneously. Therefore, all the ink is allowed to flow out, by means of gravity, towards the ink vessel 6 so that substantially all the ink is recovered.

FIGS. 4.1, 4.2 and 4.3 show the substeps of the washing step. In a first substep, the first overflow reservoir 4 is filled with water (or other washing fluid) in a manner similar to that performed with the ink in the ink filling substep. Clean water is removed from the water vessel 7 by the pump and is filled into the overflow reservoir 4. The excess water (which is now soiled) is conveyed to the vessel 8 which collects the dirty washing water. Preferably the first overflow reservoir 4 remains full of water until the plant is emptied and then filled again with ink.

FIG. 4.2 shows the following substep in which water (or some other washing fluid) is also introduced into the conduit 2 and into the other overflow reservoir 5. The washing water is introduced into the tube with a substantially laminar motion and this substantially prevents the water from filling the heads. Again the dirty water is recovered inside the vessel 8 for collecting the dirty washing water.

FIG. 4.3 shows the following substep during which water (or other washing fluid) is introduced also into the print heads. The valve V15 is opened so that the excess water from the heads passes, through the pipes 31, to the overflow reservoir 5. The excess dirty water is conveyed to the waste tank via the valves V35, V36 and V20. During this substep, the water (or other washing fluid) is allowed also to drip from the heads in order to clean the ejectors.

Preferably, the water is left inside the plant, inside the overflow reservoirs, the heads and the tube until start-up is performed again.

In addition, it is possible to envisage a system for cleaning the ejectors from the outside by a combination of water jets directed towards the ejectors and air jets for eliminating the droplets from the nozzle plates. This cleaning system, not shown, may be mounted on a carriage displaceable in a longitudinal direction of the conduit 2.

FIG. 5 shows the device 1 during discharging of the washing fluid which follows the actual washing step. During this step, as shown in FIG. 5, the valves are all open (in reality they are opened in a suitable sequence), except for those valves which lead to the water vessel and the ink vessel. Obviously the pump 9 is at a standstill during this plant discharging step.

With the device according to the present invention it is therefore possible to standardize operation of all the heads connected to the conduit and keep the ink always moving. Inside each head, during printing, a correct internal back pressure level is maintained, preventing dripping of ink from the nozzles. Advantageously, the entire circuit may be emptied of the ink and washed with a suitable washing fluid. It should be noted that the emptying and washing steps are essential when rapid-sedimentation inks are present. A further not insignificant advantage is that the quantity of waste ink is minimized.

It will therefore be possible, both at the end of the working cycle and for other contingent reasons, to empty reservoirs, heads and various tubes and to perform flushing operations which are useful both for cleaning the various pipes and in the case of any ink changes; this type of maintenance may be advised in view of machine downtime and ensures better restarting as well as a longer system life. In order to prevent critical situations arising from blockages it is also possible to envisage one or more filters even though they have not been shown in FIGS. 1-5.

Figure 6C:
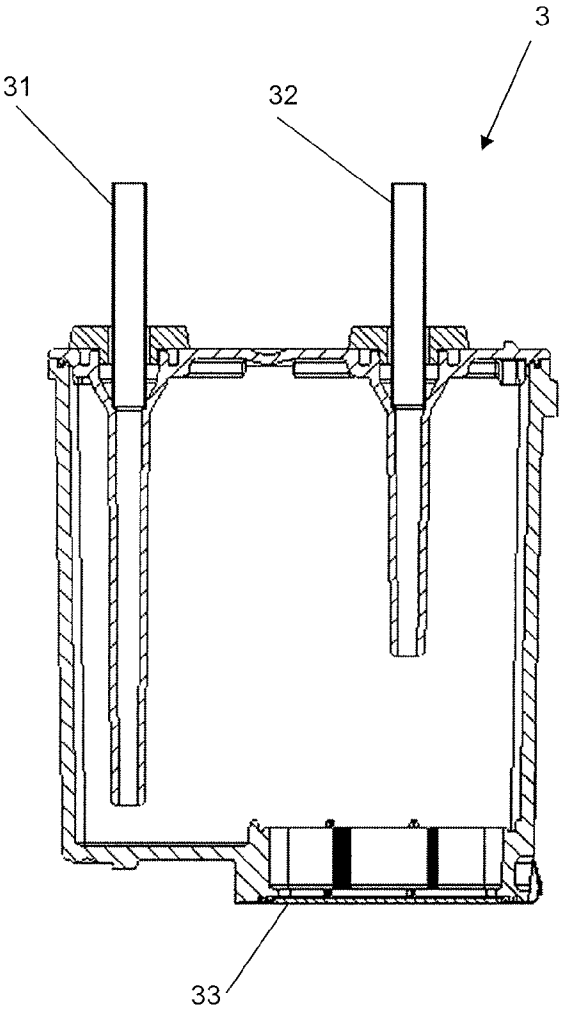
FIGS. 6*a*, 6*b* and 6*c* show a print head viewed from various angles and cross-sectioned.
Figure 6B:
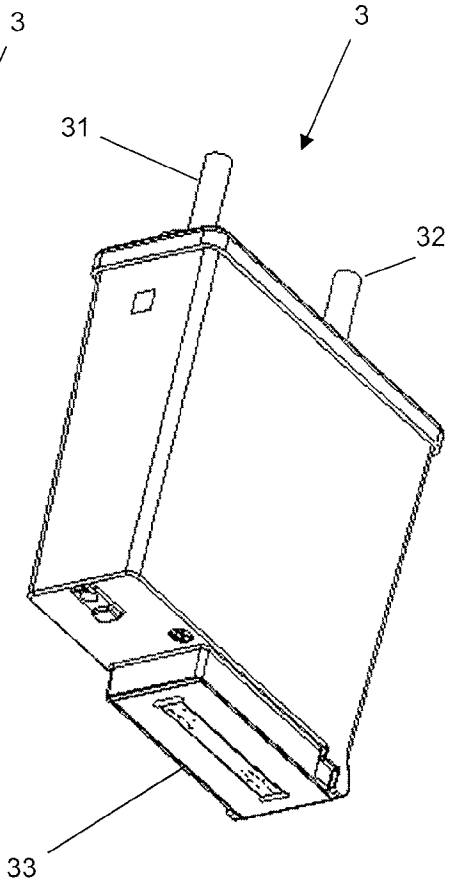
Figure 6A:
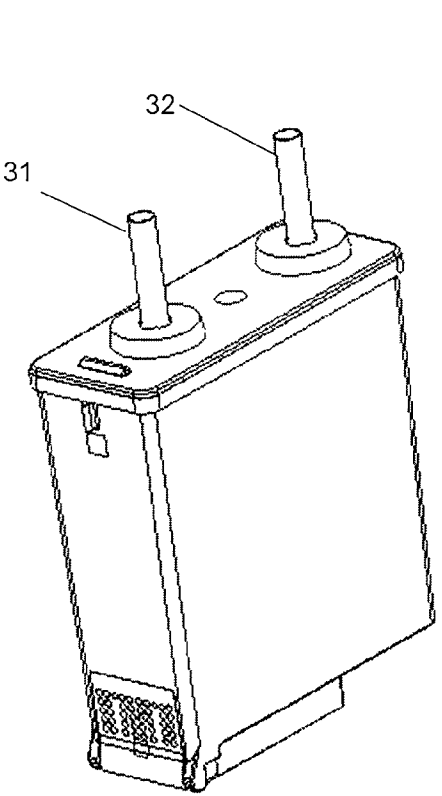
Figure 7A:
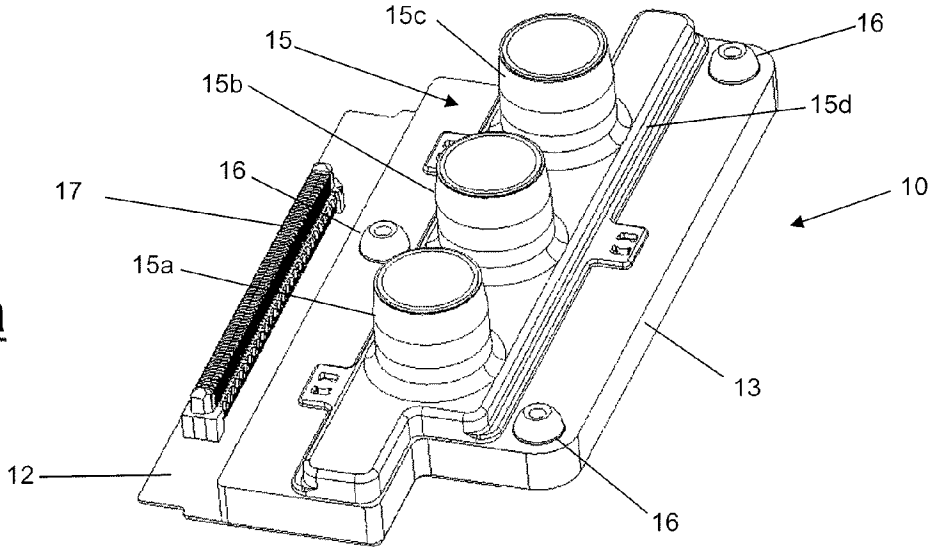
FIGS. 7*a*, 7*b*, 7*c* and 7*d* show a second module according to an aspect of the invention.
Figure 7B:
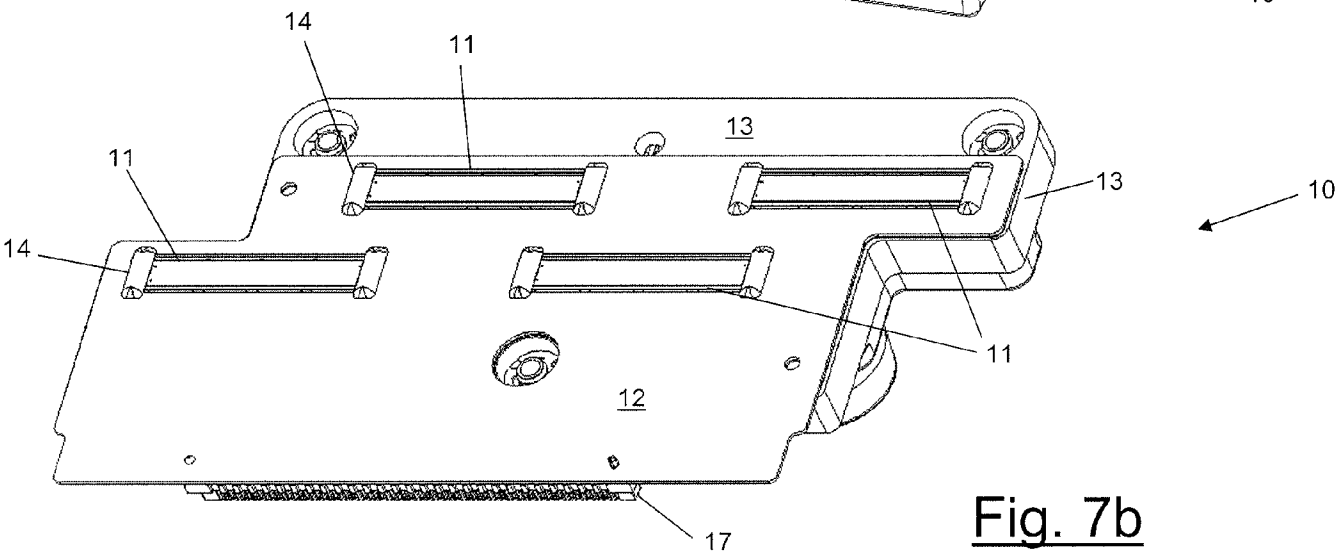
Figure 7C:
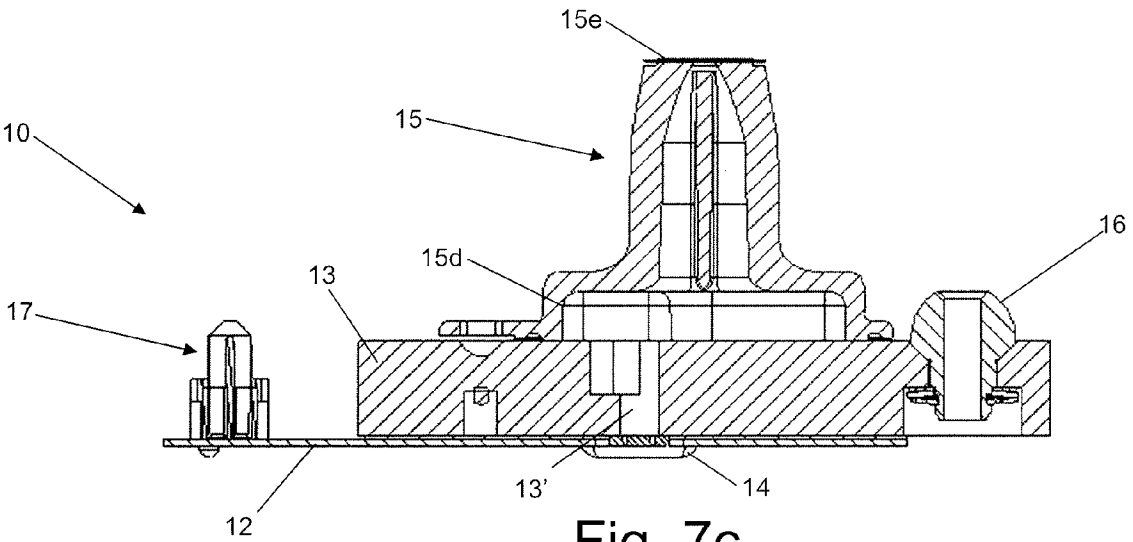
Figure 7D:
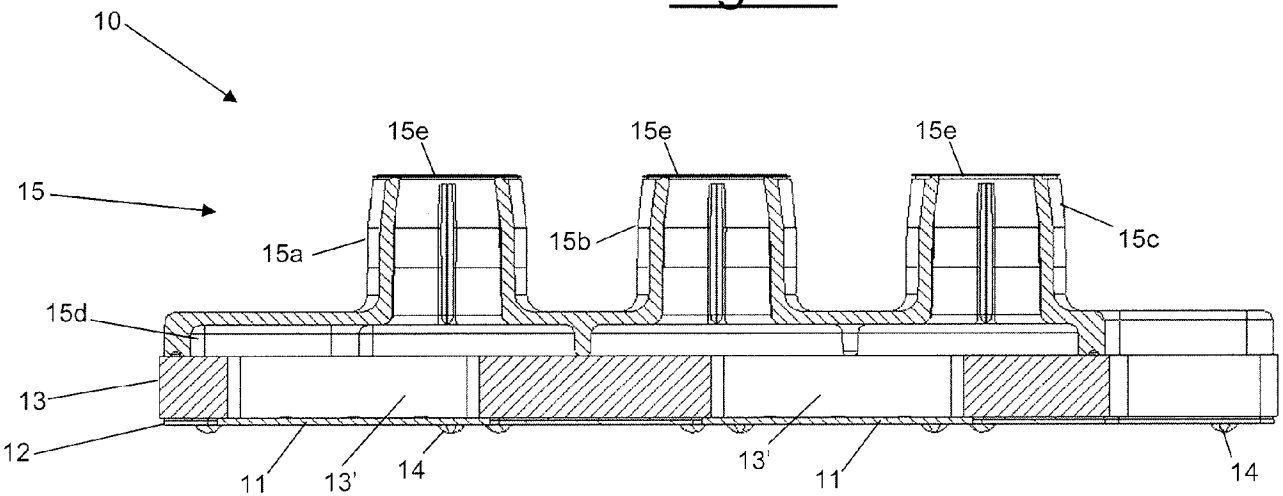

FIGS. 6*a*, 6*b* and 6*c* show a print head 3 suitable for use in the device 1 shown in FIGS. 1-5. As can be seen in FIGS. 6*a*-6*c*, the head does not contain any sponge-like bodies, but a tube for supplying/emptying the fluid 31 and an outlet tube 32. Also visible is the ejector unit with the nozzle plate 33 which, preferably, has a length of between about 10 mm and about 30 mm.

FIGS. 7*a*, 7*b*, 7*c* and 7*d* show a module 10 with a plurality of ejector units 11. FIG. 7 show four ejector units 11. Preferably, the ejector units are of the thermal ink-jet type.

This module 10, advantageously, optimizes the performance features of the device described with reference to the diagrams in FIGS. 1-5. In this case, also, there are no sponge-like bodies. Advantageously, each single nozzle plate of the respective ejector unit may have a length of between about 10 mm and about 30 mm and about 640 nozzles may be provided.

These modules 10 are assembled on a conduit 2 with a high degree of assembly precision and allow a considerable simplification of the hydraulic connections. In fact, compared to the configuration shown in FIGS. 1-5 with two pipes 31, 32 for each head 3 to be connected to each conduit 2, a condition is assumed where supplying of the single modules 10 is obtained by connections directly on the conduit itself. With this configuration major improvements in the relative alignment of the various nozzle plates and consequently the printing precision are obtained. Moreover, with regard to start-up with single heads, the quantity of ink which "settles" on top of the nozzle is also kept to a minimum, this being an important detail since a rapid-sedimentation ink may be used.

Preferably, each module 10 comprises a printed circuit 12 with an electrical connector 17. The printed circuit 12 is shaped in a suitable manner with two parts staggered relative to each other. The printed circuit 12 comprises a certain number of eyelets for the ejector units. A head support 13 is associated with the opposite side of the printed circuit. The head support 13 is preferably made of material with a thermal expansion factor as close as possible to that of silicon (which substantially forms the ejector units 11). Preferably, the head support 13 is glued or fastened in some other way to the printed circuit 12. Preferably, the ejector units 11 are glued to the head support 13. However, welds 14 are performed between the ejector units 11 and electrical paths formed on the printed circuit 12 in order to stabilise the electrical contacts.

The opposite side of the head support is provided with a header body 15 having a common flat chamber 15*d* and a plurality of projecting chimneys 15*a*, 15*b* and 15*c* designed to engage inside suitable openings in the conduit 2. The projecting chimneys 15*a-c* are preferably provided with respective filtering elements 15*e*, with an impurity retaining mesh, which may also be small. Preferably, the projecting chimneys 15*a-c* project with respect to the common chamber 15*d* by about 20 mm. Preferably, the projecting chimneys 15*a-c* are flared towards their end opposite to the common chamber.

The chimneys and the common chamber are in communication with the ejector units 11 via suitable openings 13' in the head support 13. In this way the ink may reach the ejector units 11.

Each module 10 is also provided with centering/alignment elements 16, for example in the form of spherical or semi-spherical centering bushes which, as will become clear below, engage inside corresponding longitudinal and transverse seats of a main support which will be described below.

Figure 8:
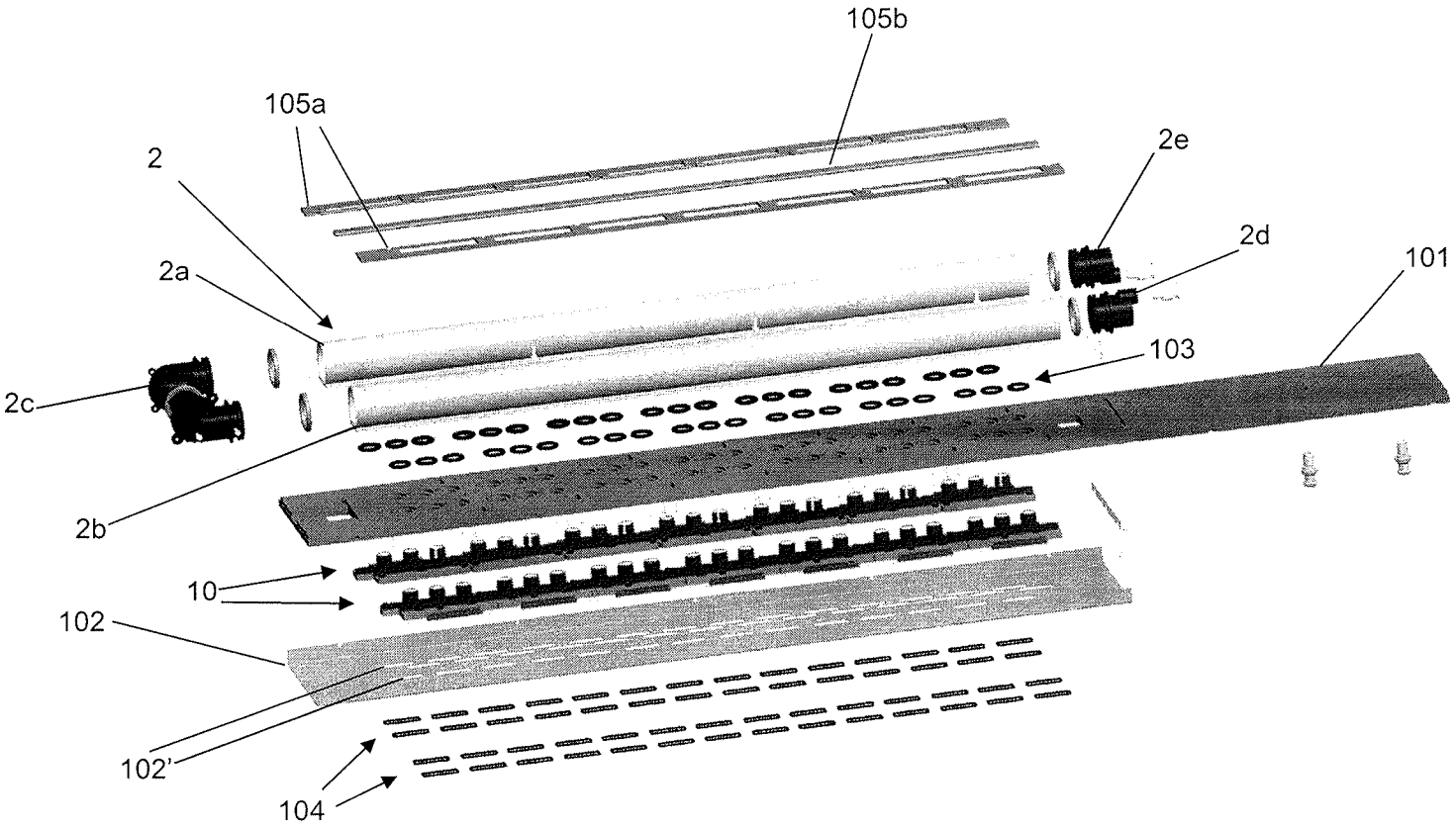
FIG. 8 is an exploded view of a plurality of modules associated with an ink conveying conduit.
Figure 9:
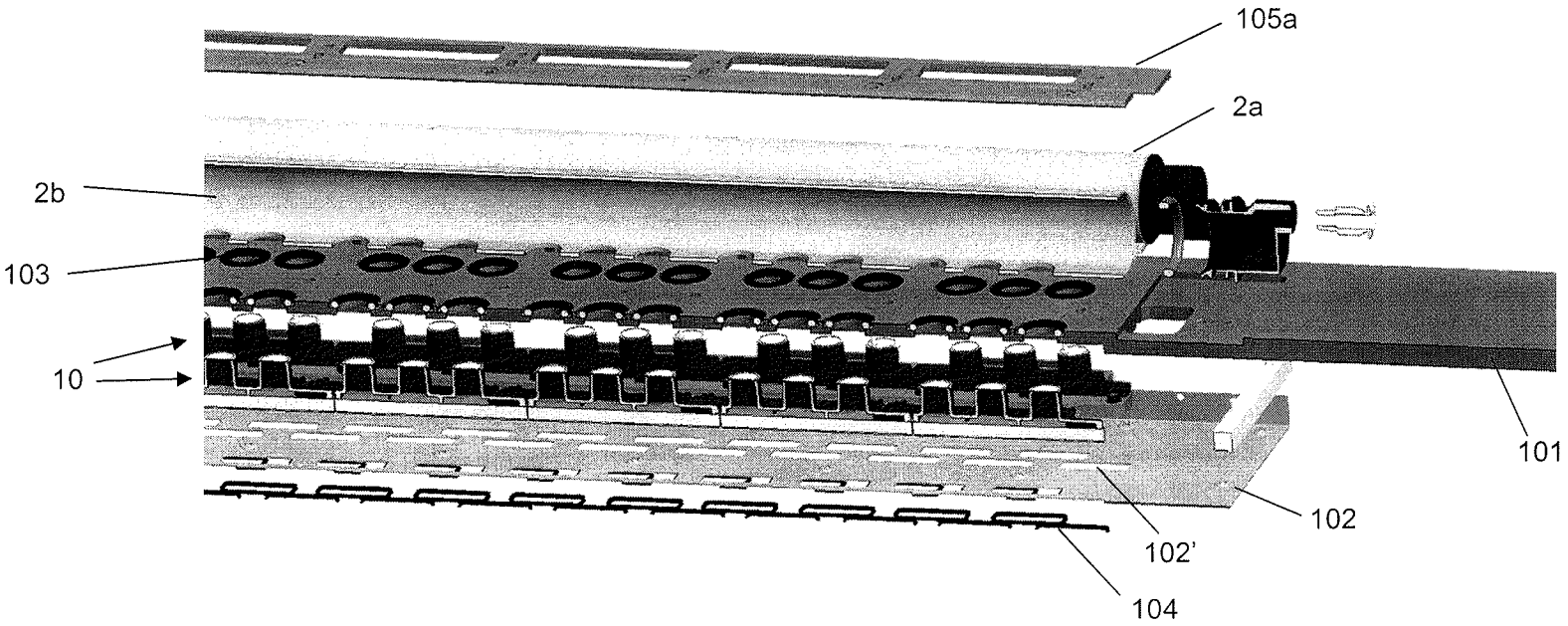
FIG. 9 is an exploded section similar to FIG. 8.

Advantageously, each module 10 can be associated with other modules so as to form a series of associated modules and therefore ejector units 11. FIGS. 8 and 9 show two parallel rows of modules 10 which are designed to engage inside a twin conduit 2. The twin conduit 2 comprises two parallel tubes 2*a*,2*b* which are connected together by a U-shaped joint 2*c* (which can be seen on the left-hand side in FIG. 8). The inlet 2*d* and the outlet 2*e* for the ink are provided at the other end of the twin duct 2. For fluid-dynamic reasons, the inlet 2*d* is preferably on the top tangency of the tube 2*a* and the outlet 2*e* is preferably on the bottom tangency of the other tube 2*b*. Preferably, as clearly shown in FIG. 10, each single pipe 2*a*, 2*b* has an omega shape and has a substantially circular internal section and a flat base which forms a pair of longitudinal flanges for stably fixing the pipes 2*a*, 2*b* to a main plate 101.

When the projecting chimneys 15*a-c* are inserted into the twin conduit 2, they project by about 5 mm-10 mm.

Figure 10:
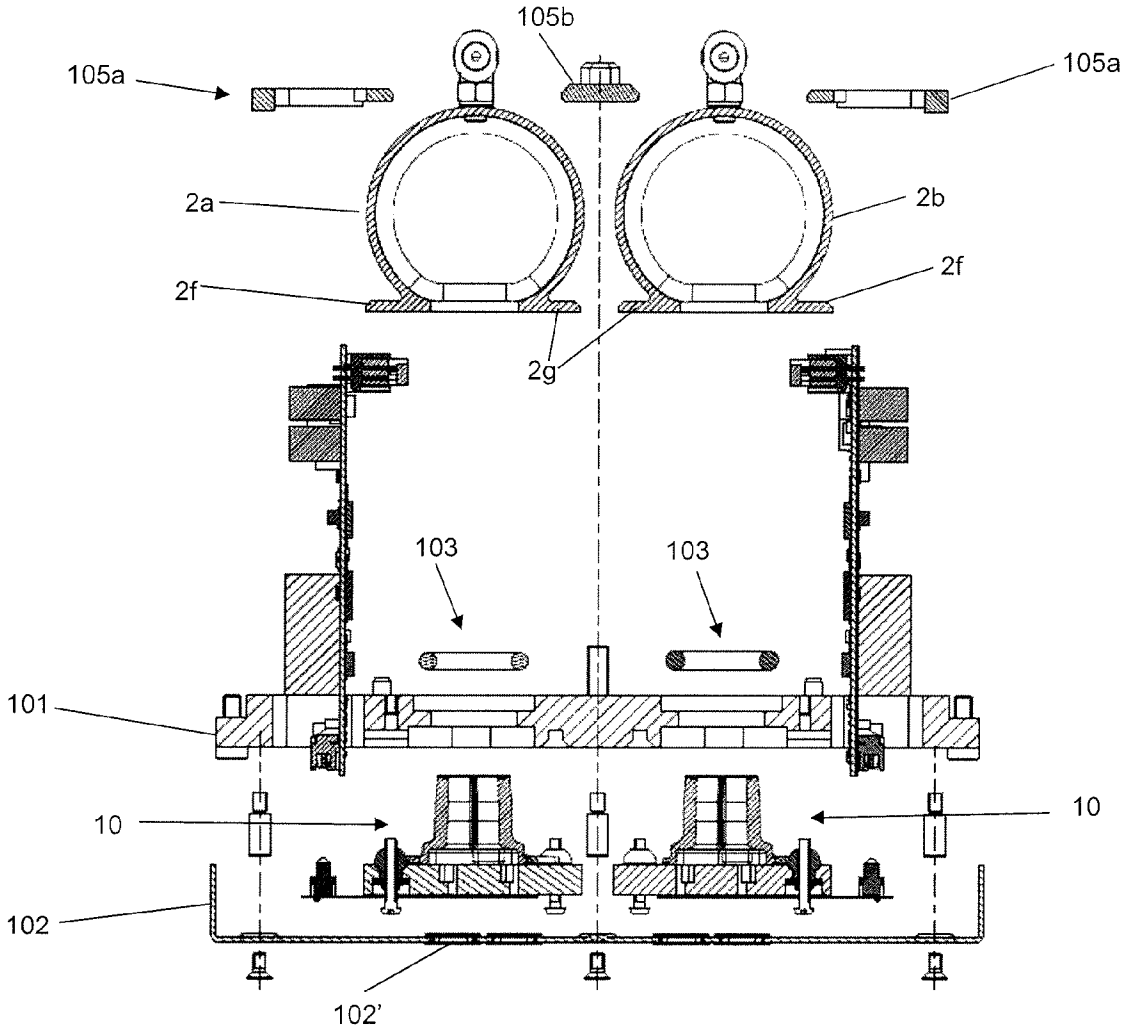
FIG. 10 is a cross-section through the modules and the conduits according to FIG. 9.

FIG. 9 is a simplified exploded view of a part of a system which uses a plurality of modules 10. An exploded cross-section of the same system is shown in FIG. 10. The system comprises a twin tube 2 with a U-shaped joint (not shown) for connecting them, an inlet joint and an outlet joint. The system also comprises a thick, long, suitably perforated plate 101 which acts as a main support plate, two rows of modules 10 and a bottom cover 102 with a plurality of eyelets 102' opposite the ejector units of the various combined modules 10. Advantageously, ring seals 103 are envisaged for ensuring the seal between the projecting chimneys 15*a-c* and the twin conduit 2. Advantageously seals 104 shaped as eyelets 102' are also envisaged for preventing washing water or other impurities from striking the printed circuit part. Basically only the ejector units and the ejection plates are left exposed. The two tubes 2*a* and 2*b* are fixed to the main plate 101 via fixing profiles 105*a* and 105*b*. In particular, two profiles 105*a* are provided for fixing the external flanges to the main plate 101 and a profile 105*b* is provided for fixing the central or internal flanges.

As mentioned above, ring seals 103 are preferably provided between the chimneys and the tubes 2*a* and 2*b*. Advantageously, these seals are housed inside seats formed in the thickness of the main plate 101. These seats are shaped so as not to allow the seals to expand diametrically outwards, but only diametrically inwards. In this way, when the two tubes 2*a* and 2*b* are fixed to the main plate 101, they crush the seals 103 which are deformed diametrically inwards, providing a fluid seal between the tubes 2*a* and 2*b* and the chimneys of the modules 10.

Advantageously, in addition to the main plate, two sidewalls may be envisaged (FIG. 10) for forming a box-like body. The sidewalls are also able, for example, to support electronic circuits for driving the ejector units 11 and generally the modules 10 of the ink-jet print heads.

The conduit 2 and the heads 3 shown in FIGS. 1-5 may be advantageously replaced by the tubes 2*a*, 2*b* and the (double) series of modules 10, in addition to the main plate, the sidewalls, the fixing profiles, the bottom cover, the seals and the joints described with reference to FIGS. 7 to 10.

As mentioned above, the set of components described with reference to FIGS. 7 to 10 is very advantageous in that it improves significantly the assembly and printing precision.

The invention claimed is:

1. An ink-jet printing device comprising:

a first reservoir structured and arranged to contain a first volume of printing fluid at a first level with respect to a reference plane;

a supply system structured to force the printing fluid towards the first reservoir;

a second reservoir structured and arranged to contain a second volume of printing fluid at a second level with respect to the reference plane, the second level being lower, relative to the reference plane, than the first level by a level difference value;

a conduit structured and arranged to receive the printing fluid from the first reservoir and to convey the printing fluid towards the second reservoir;

ejector units arranged to receive printing fluid from the conduit;

an ejection plane in which the ejector units lie, the ejection plane being located at a height relative to the reference plane that is higher than an average of the first level and the second level so as to generate a back pressure in the ejector units, wherein a flowrate of the printing fluid inside the conduit is greater than a maximum flowrate of the printing fluid ejectable from the ejector units; and a vessel structured and arranged to contain a volume of printing fluid and to collect printing fluid discharged from at least the conduit.

2. The device according to claim 1, wherein the printing fluid comprises ink.

3. An ink-jet printing device comprising:

a first reservoir structured and arranged to contain a first volume of printing fluid at a first level with respect to a reference plane;

a supply system structured to force the printing fluid towards the first reservoir;

a second reservoir structured and arranged to contain a second volume of printing fluid at a second level with respect to the reference plane, the second level being lower, relative to the reference plane, than the first level by a level difference value;

a conduit structured and arranged to receive the printing fluid from the first reservoir and to convey the printing fluid towards the second reservoir;

an ejection plane in which ejector units lie, the ejection plane being located at a height relative to the reference plane that is higher than an average of the first level and the second level so as to generate a back pressure in the ejector units, wherein a flowrate of the printing fluid inside the conduit is greater than a maximum flowrate of the printing fluid ejectable from the ejector units; and a vessel structured and arranged to contain a volume of washing fluid for flushing at least the first reservoir and the conduit.

4. An ink-jet printing device for supplying an ink-jet printing device with a printing fluid, comprising:

supplying to a first reservoir a first volume of printing fluid to a first level with respect to a reference plane;

supplying, via a conduit, the printing fluid from the first reservoir to an ejection plane in which ejector units are arranged;

supplying to a second reservoir from the conduit a second volume of printing fluid to a second level with respect to the reference plane; and arranging the second level lower in relation to the reference plane than the first level by a level difference value to obtain a flow of printing fluid between the first reservoir and the second reservoir, so that a flowrate of the printing fluid inside the conduit is greater than a maximum flowrate of the printing fluid ejectable from the ejector units; and a module comprising at least two ejector units, a printed circuit, a head support and a header for defining a single volume structured to contain printing fluid for the ejector units, wherein the header is structured and arranged to be connected in fluid communication with the conduit and to receive printing fluid from the conduit, wherein the head support comprises graphite.

5. An ink-jet printing device comprising:

a first reservoir structured and arranged to contain a first volume of printing fluid at a first level with respect to a reference plane;

a supply system structured to force the printing fluid towards the first reservoir;

a second reservoir structured and arranged to contain a second volume of printing fluid at a second level with respect to the reference plane, the second level being lower, relative to the reference plane, than the first level by a level difference value;

a conduit structured and arranged to receive the printing fluid from the first reservoir and to convey the printing fluid towards the second reservoir; and an ejection plane in which ejector units lie, the ejection plane being located at a height relative to the reference plane that is higher than an average of the first level and the second level so as to generate a back pressure in the ejector units, wherein a flowrate of the printing fluid inside the conduit is greater than a maximum flowrate of the printing fluid ejectable from the ejector units, wherein the printing fluid is a ceramic ink.

6. A method for supplying an ink-jet printing device with a printing fluid, comprising:

supplying to a first reservoir a first volume of printing fluid to a first level with respect to a reference plane;

supplying, via a conduit, the printing fluid from the first reservoir to an ejection plane in which ejector units are arranged;

supplying to a second reservoir from the conduit a second volume of printing fluid to a second level with respect to the reference plane; and arranging the second level lower in relation to the reference plane than the first level by a level difference value to obtain a flow of printing fluid between the first reservoir and the second reservoir, so that a flowrate of the printing fluid inside the conduit is greater than a maximum flowrate of the printing fluid ejectable from the ejector units, wherein the printing fluid is a ceramic ink.

* * * * *